US012606997B2

(12) United States Patent
Hawksby

(10) Patent No.: US 12,606,997 B2
(45) Date of Patent: Apr. 21, 2026

(54) SHOWER HEAD ATTACHMENT

(71) Applicant: SOAPERY PTY LTD, Williams Landing (AU)

(72) Inventor: Raphael Hawksby, Williams Landing (AU)

(73) Assignee: SOAPERY PTY LTD (AU)

( * ) Notice: Subject to any disclaimer, the term of this patent is extended or adjusted under 35 U.S.C. 154(b) by 182 days.

(21) Appl. No.: 18/241,571

(22) Filed: Sep. 1, 2023

(65) Prior Publication Data

US 2024/0368867 A1 Nov. 7, 2024

(30) Foreign Application Priority Data

May 2, 2023 (AU) ..... 2023901290

(51) Int. Cl.
*E03C 1/046* (2006.01)
*E03C 1/04* (2006.01)

(52) U.S. Cl.
CPC ..... *E03C 1/0465* (2013.01); *E03C 1/0408* (2013.01)

(58) Field of Classification Search
CPC ..... B05B 7/2462; B05B 1/185; E03C 1/0408; E03C 1/0465; A47K 3/281
See application file for complete search history.

(56) References Cited

U.S. PATENT DOCUMENTS 1,973,319 A * 9/1934 Nelson ..... E03C 1/0465 239/315
2,485,112 A 10/1949 Rose
2,659,627 A 11/1953 Mcconnell

FOREIGN PATENT DOCUMENTS

AU 2010100322 A4 7/2010
DE 202009013692 U1 * 1/2011 ..... B01F 3/0865
WO 2004113628 A1 12/2004

OTHER PUBLICATIONS

Australian Search Report in AU Patent Application No. 2023901290 dated Jun. 5, 2023.

* cited by examiner

*Primary Examiner* — Jennifer C Chiang
(74) *Attorney, Agent, or Firm* — Dilworth IP, LLC

(57) ABSTRACT

A shower head attachment provides a method of dispensing a water-soluble product such as soap or scents or the like from a shower head and includes a perforated cage having a body with a circumferential side for substantially underlying a shower head. One or more retainers extend from the circumferential side for resiliently extending around and retaining the shower head attachment to the shower head, wherein the retainer is adapted to be detachably resiliently securable to the shower head.

20 Claims, 12 Drawing Sheets

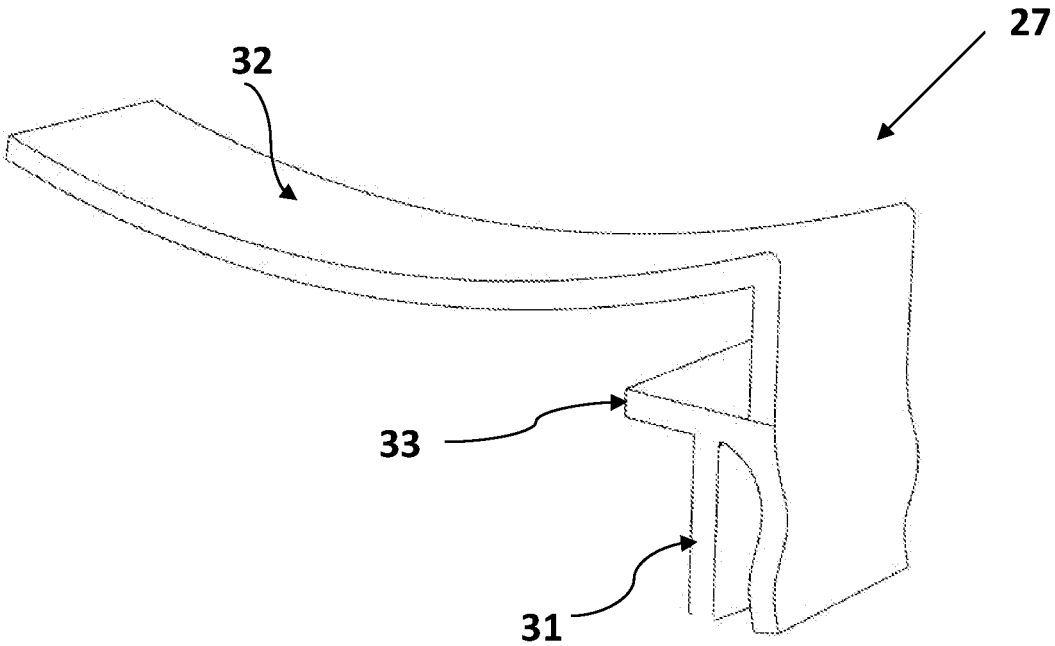
FIGURE 8
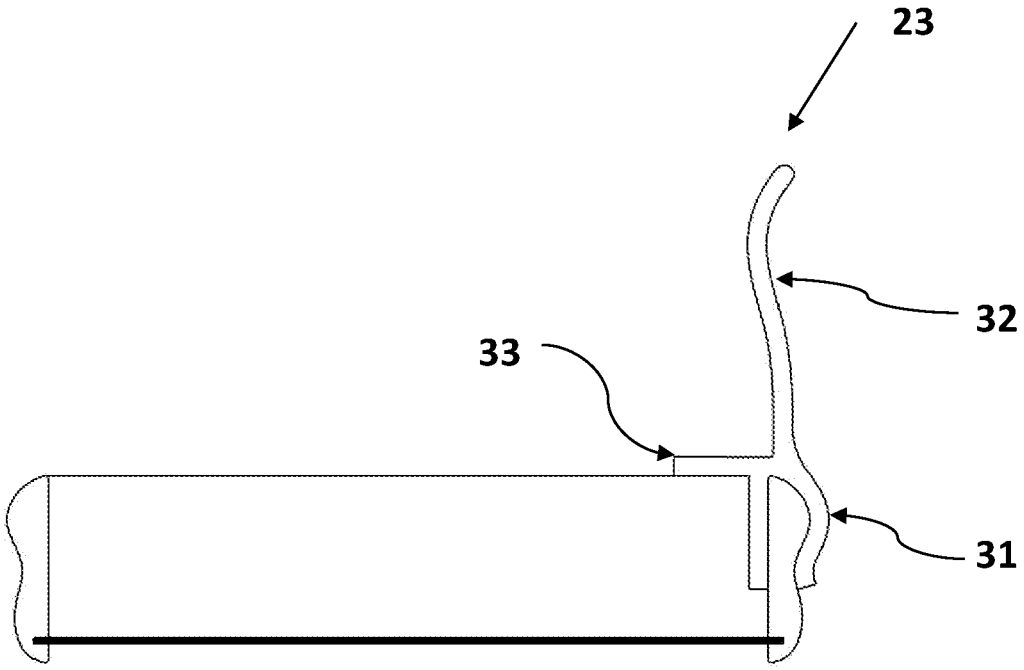

FIGURE 16
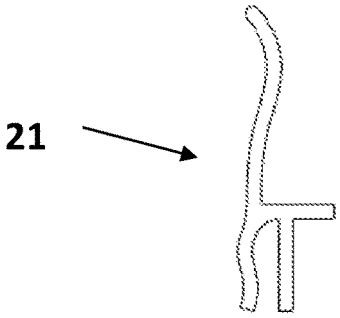
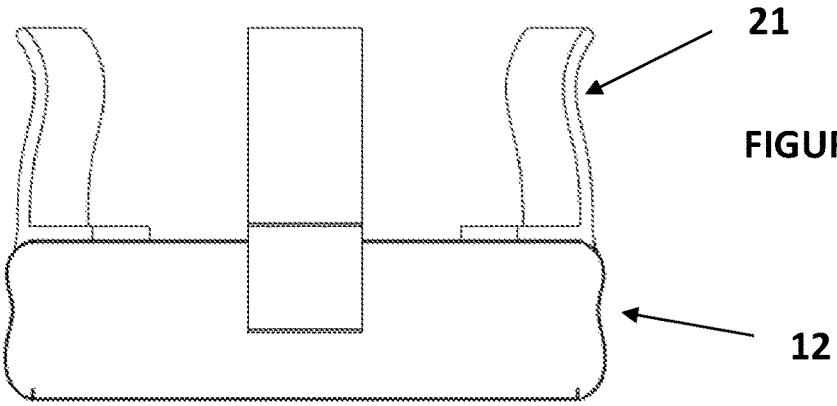
FIGURE 17
FIGURE 18
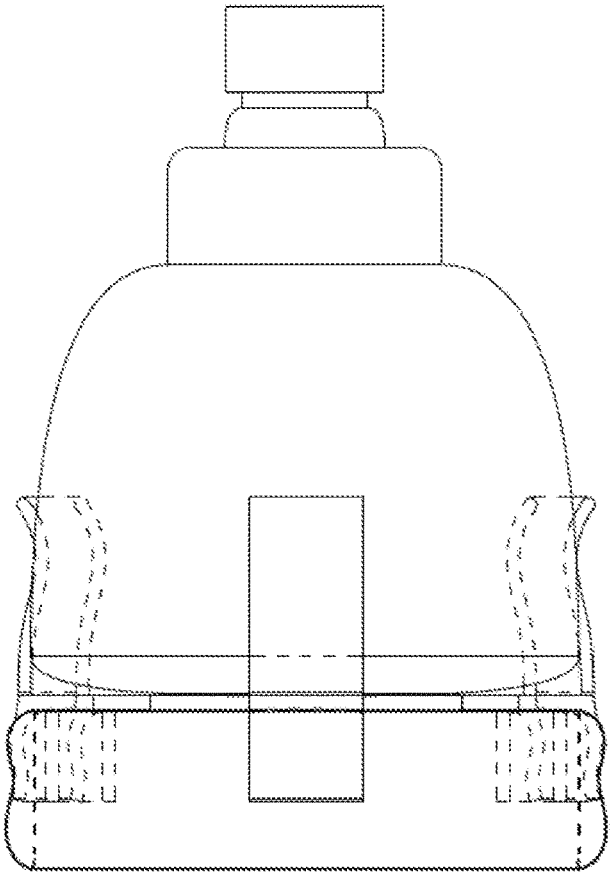

SHOWER HEAD ATTACHMENT

FIELD OF THE INVENTION

The present invention relates to a shower head attachment and in particular to a shower head attachment that can be used for dispensing a water-soluble product such as soap or scents or oils or the like.

The invention has been developed primarily for use with shower heads, whether they are fixed bathroom overhead shower heads, or manually movable shower heads attached to flexible piping and will be described hereinafter with reference to these applications. However, it will be appreciated that the invention is not limited to this particular field of use.

BACKGROUND OF THE INVENTION

A shower head generally comprises a planar extending structure with an upper and lower surface forming an internal volume. The upper surface can be a rounded or flat surface connecting to a water feeding tube extending from bathroom roof or wall and connected to the bathroom plumbing. The lower surface is spaced from the upper surface and has perforations. Water fed from the bathroom plumbing through the narrow water feeding tube enters the internal volume and is dispersed to allow to be dispensed across the large diameter of the shower head through perforations of its lower surface. The shaping or sizing of the shower head could be circular or square or other shape and have various circumferential dimensions.

Generally, the rate of water flow is a function of water pressure and thereby water inlet speed, together with the sizing of the perforations of the perforated lower surface. There can be many choices of shower head. A first having a large head but small perforations could deliver the same water flow as a smaller head with larger perforations.

It is known in baths to have a water-soluble product in order to enhance cleanliness, enhance mood, enhance experiences of senses whether through touch, smell or otherwise. One form of bath bomb can comprise bicarbonate of soda, citric acid and essential oils together with coloring and scents. The primary element is to be water soluble but over a time period rather than instant solubility or effervescence. It is considered a need to provide users of showers to have the same benefits. However the plumbing of baths is significantly different to showers.

It can be seen that known prior art shower head attachments have the problems of:

a) Not allowing use of water-soluble products for enhancing showering experience like provided in an enhanced bath experience
b) The internal volume of a showerhead is not accessible as shower heads are complete sealed units.
c) There are many different sized and shaped shower heads and not possible to modify to provide a water-soluble dispersing system
d) There are many different sized and shaped shower heads and therefore not able to use one attachment.

The present invention seeks to provide a shower head attachment, which will overcome or substantially ameliorate at least one or more of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE INVENTION

According to a first aspect of the present invention there is provided a shower head attachment for use with a shower head including a perforated cage having a body with a rim, an open top, a base having perforations wherein in use the perforated cage is for substantially underlying a substantial portion of the shower head perforations of the shower head, one or more resilient retainers detachably attached to the rim of the shower head attachment and extendible at least partially around the shower head for resiliently retaining the shower head attachment to the shower head, and the retainer being adapted to be detachably securable to the shower head. The perforated cage can underly the shower head and is adapted to contain one or more water-soluble products such as soap or scents or the like to allow dispending when water flows through the perforated cage.

Preferably the size and quantity of the perforations of the perforated cage are less than the size and quantity of the perforations of the showerhead so as to avoid back pressure.

The shower head attachment can have a body of the perforated cage including a circumferential rim surrounding an open top of the perforated cage, wherein the circumferential rim and the retainer allow for ready detachable positioning on the shower head, with said perforated cage at its open top being adapted to abut and underlie a substantial portion of the shower head perforations.

One or more retainers can be included with at least one extending from the circumferential rim to overlay a rear of the shower head in use when the perforated cage underlies the shower head. Preferably the one or more retainers extend from spaced opposing positions on the circumferential rim. This includes three or four retainers spaced evenly around the circumferential rim and extending axially or just offset axially so as to avoid engaging the water inlet pipe of the shower head.

The one or more retainers can be resilient towards the perforated cage to provide a resilient clamping of the shower head attachment to the shower head in use.

In one form the one or more retainers are fixed to the circumferential rim.

However, in another and more inventive form the one or more retainers are detachably attached to the circumferential rim. This detachable attached to the circumferential rim by the retainer can be by having a shaped attachment means that matches a shaping of the circumferential rim.

The resilience of the one or more retainers can include a resilient hinge between the attachment means and the resilient arm. However separately or in combination the resilience of the one or more retainers can include the resilient arm having a flexibility tending to return a deformation back to the original position so as to provide a clamping tension.

The shaped attachment means of the detachable retainer can include a two-pronged attachment means forming an internal shaping the matches and clips over the shaping of the circumferential rim.

It can be seen that the features of the shower head attachment can be used in various combinations to provide substantial improvements and the features act synergistically to combine the benefits and provide an unexpected, improved result.

The invention also provides a novel and inventive method of dispensing a water-soluble product such as soap or scents or the like from a shower head including the steps of:

a. Providing a shower head attachment having a perforated cage substantially coextensive with the shower head, the shower head attachment having an open top defined by a circumferential rim, and at least one resilient arm extending from the circumferential rim;
b. Resiliently clamping the perforated cage around a shower head by use of the resilient adaptation of the resilient arm to the perforated cage;
c. Providing a one or more water soluble products such as soap or scents into the perforated cage for being in water flow path when shower head attachment is mounted to the shower head;

The size and quantity of the perforations of the perforated cage are less than the size and quantity of the perforations of the showerhead so as to avoid back pressure.

It can be seen that the invention provides a shower head attachment and method of dispensing a water-soluble product such as soap or scents or the like from a shower head with substantial improvements including any one or more of the following:

i. improvements in structure and assembly allowing for the use of water soluble products from a shower head
ii. Improvements in adaptive design and construction to allow use with a large range of shower heads
iii. Improvements in attachment to allow ready location to a large range of shower heads without needing to adapt the shower head.
iv. Improvements in design allowing versatility and ease of assembling the shower head attachment.
v. Improvements in structure to allow easier flow of water for a large range of shower heads.

Other aspects of the invention are also disclosed.

BRIEF DESCRIPTION OF THE DRAWINGS

Notwithstanding any other forms which may fall within the scope of the present invention, preferred embodiments of the invention will now be described, by way of example only, with reference to the accompanying drawings in which:

FIGS. 8, 9 and 10 are diagrammatic views of different forms of retainers for retaining the shower head attachment to the shower head;

FIG. 16 is a cross sectional view of one form of the retainer for retaining the shower head attachment in accordance with a further preferred embodiment of the present invention;

FIG. 17 is a diagrammatic view of one form of a retainer for retaining the shower head attachment to the shower head in accordance with a further preferred embodiment of the present invention;

FIG. 18 is a diagrammatic view of one form of a retainer attached to the shower hear in accordance with a further preferred embodiment of the present invention;

DETAILED DESCRIPTION OF THE INVENTION

Figure 1:
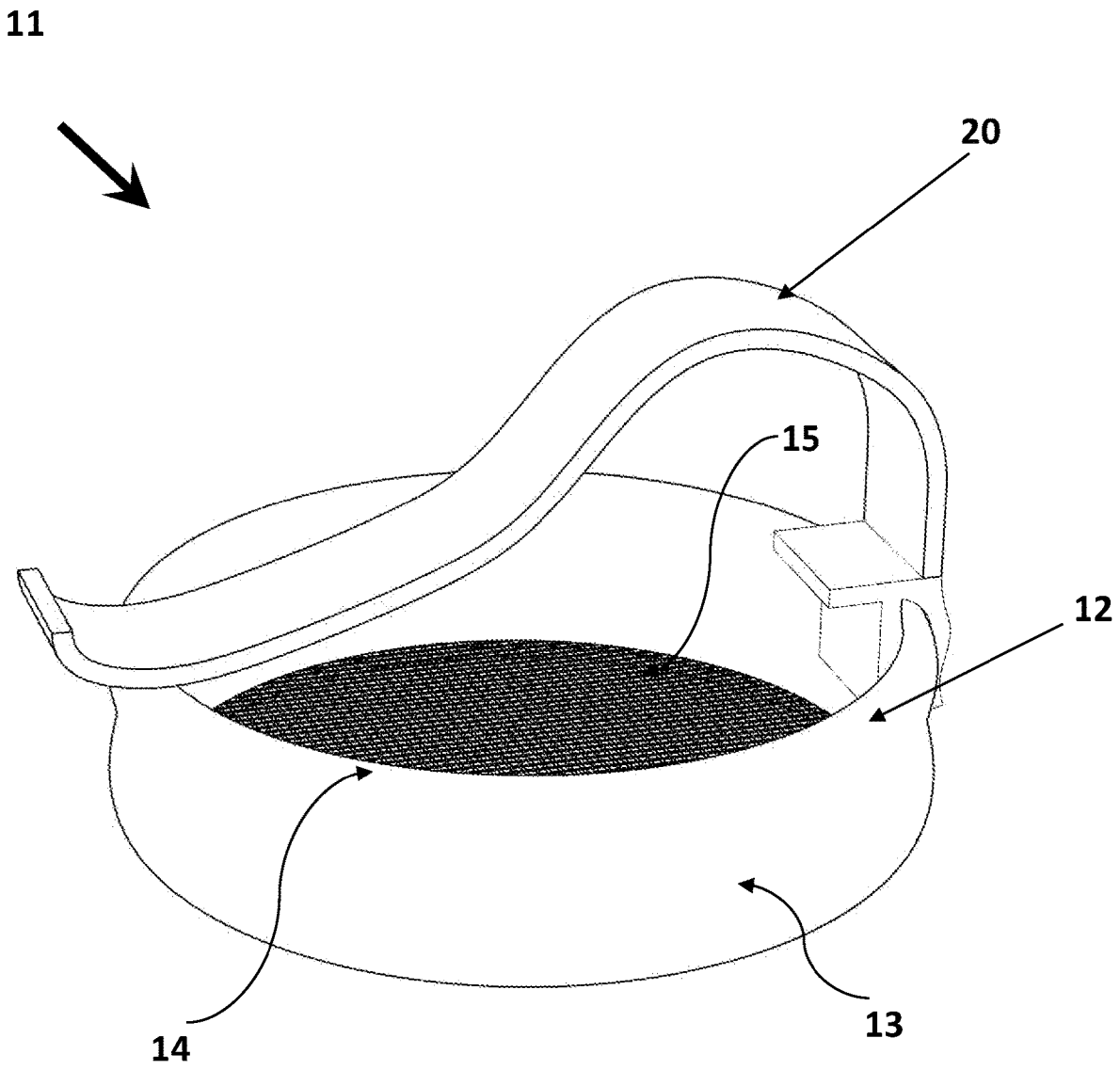
FIG. 1 is a diagrammatic view of a shower head attachment in accordance with a preferred embodiment of the present invention.
Figure 2:
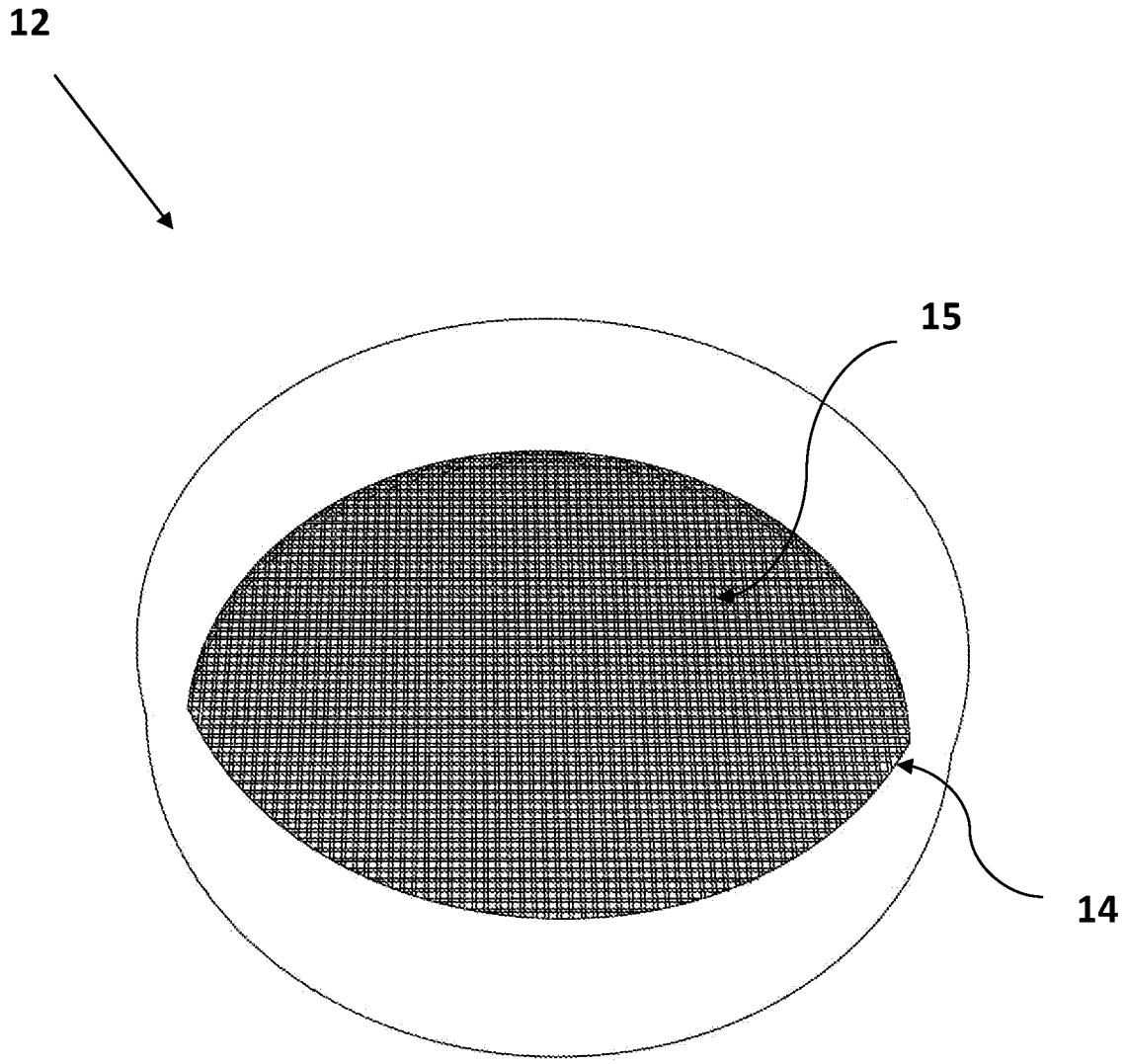
FIG. 2 is a diagrammatic view of a perforated cage in accordance with a preferred embodiment of the present invention.
Figure 3:
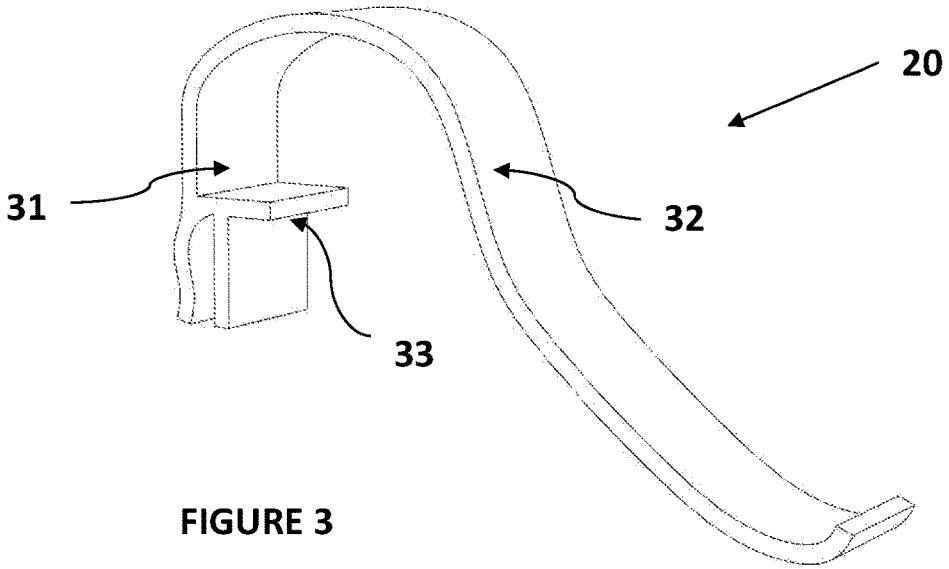
FIGS. 3 and 4 are diagrammatic views of different forms of retainers for retaining the shower head attachment to the shower head in accordance with a further preferred embodiment of the present invention.
Figure 4:
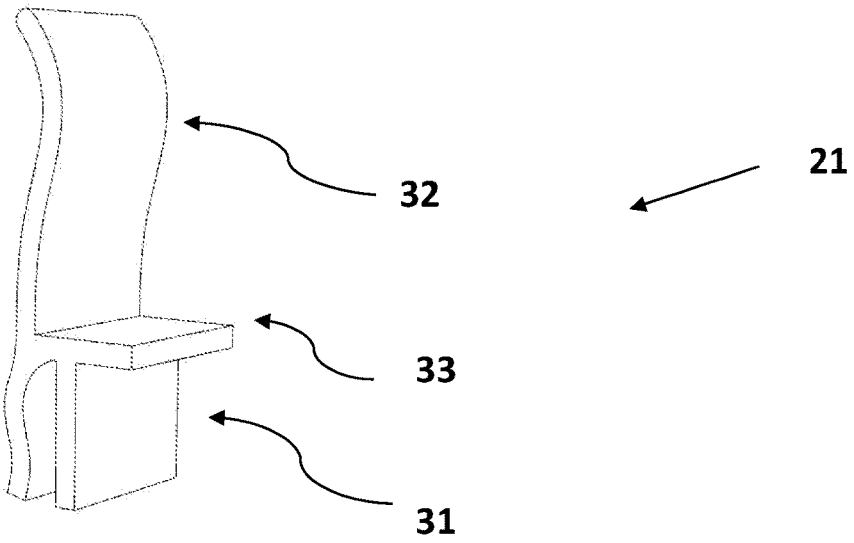
Figure 5:
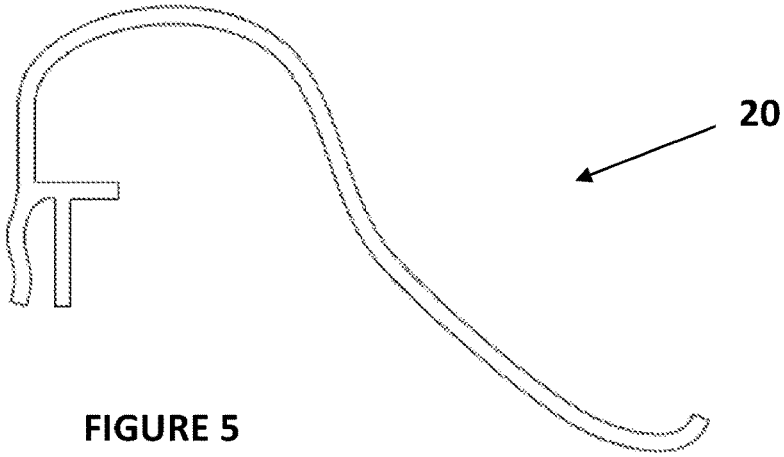
FIGS. 5 and 6 are cross sectional views of the different forms of retainers for retaining the shower head attachment to the shower head in accordance with a further preferred embodiment of the present invention.
Figure 6:
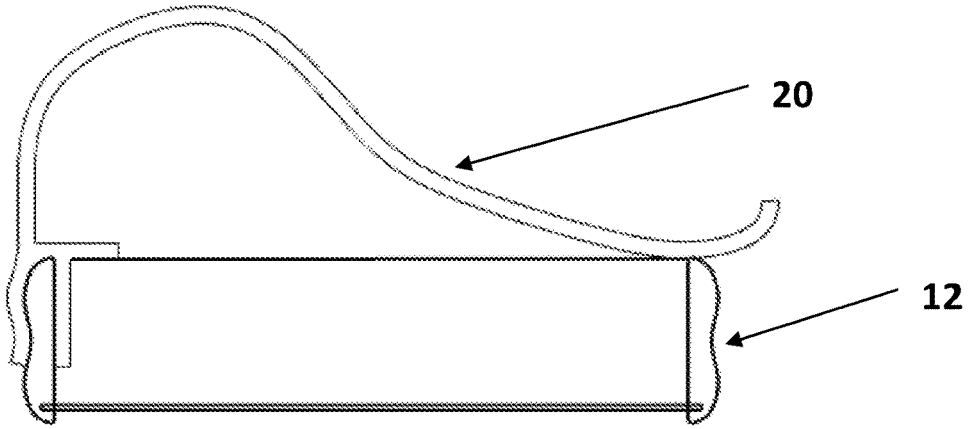
Figure 7:
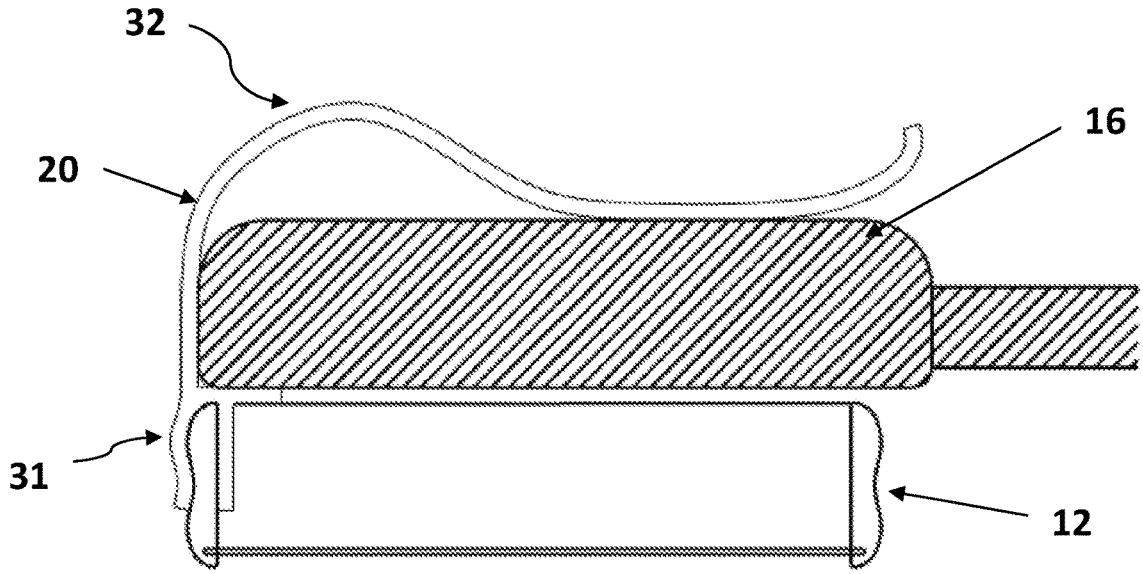
FIG. 7 is a cross sectional view of one form of the retainer attached to the shower head in accordance with a further preferred embodiment of the present invention.
Figure 9:
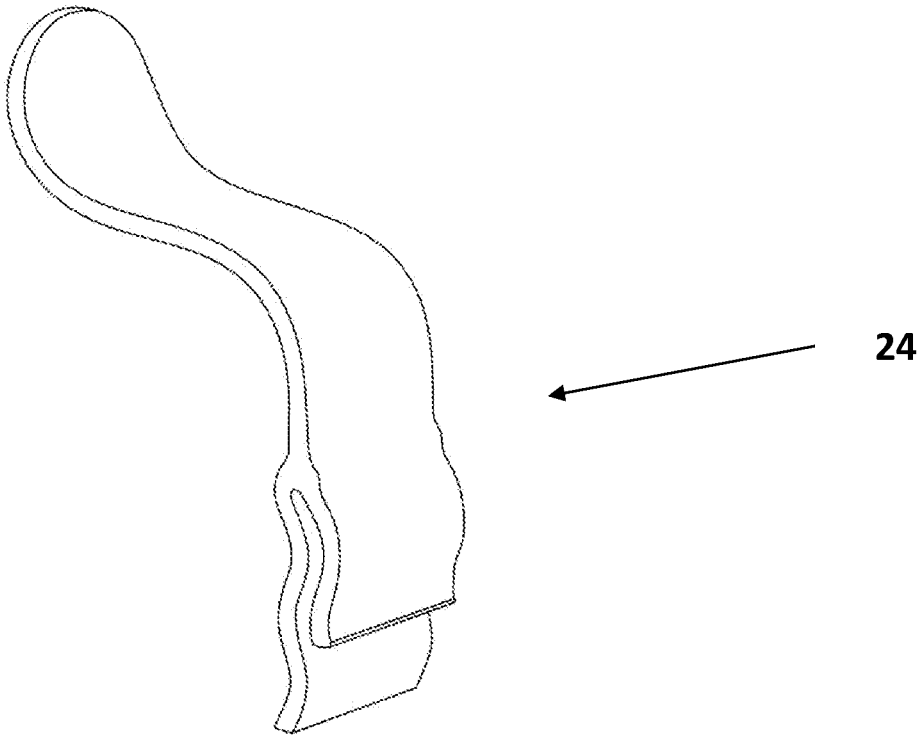

It should be noted in the following description that like or the same reference numerals in different embodiments denote the same or similar features.

Referring to the drawings and particularly FIG. 1, there is shown a shower head attachment 11 for use with a shower head, (not shown). The shower attachment includes a perforated cage 12 having a body 13 with a circumferential side 14 for substantially underlying a shower head. One or more retainers 20 are provided extending from the body 13 for retaining the shower head attachment to the shower head, wherein the retainer is adapted to be detachably resiliently securable to the shower head.

Container for Adjacent Location

The perforated cage 12 that underlies the shower head is adapted to contain one or more water-soluble products (not shown) such as soap or scents or the like to allow dispensing when water flows through the perforated cage.

The container does not need to "fit" or connect with the shower head but to be held against the lower surface of the shower head to receive the majority if not all of the fluid expelled from the shower head. The body of the perforated cage includes a circumferential rim 14 surrounding an open top of the perforated cage, wherein the circumferential rim and the retainer allow for ready detachable positioning on the shower head, with said perforated cage at its open top being adapted to abut and underlie a substantial portion of the shower head perforations.

This is particularly beneficial in therefore not requiring each shower head attachment to be exactly matching the shower head profile. Instead, a single shower head attachment can apply to a range of showerheads that are of similar sizing.

Additionally, since the container is not closely fitted to the shower head and the circumferential rim 14 creates a considerable height difference from the lower surface of the shower head to the perforated cage 12, a variety of sizes of water-soluble products may be placed on top of the perforated cage 12.

Mesh Not Limiting Flow

A shower head attachment is not a pressure resisting trap but instead allows ready flow of the liquid from the shower head to readily pass through the perforated cage 12. This is achieved by the size and quantity of mesh or perforations 15 of the perforated cage 12 that are less than the size and quantity of the area size of the perforations of the shower-head so as to avoid back pressure.

That is the sizing, number and area of the perforations provide a particular flow rate from the shower head at standard mains pressure water supply. The perforations 15 of the perforated cage 12 are sized shaped and area size to be in total substantially equal to or greater than the flow rate provided by the shower head so that there is no build-up of back pressure liquid in the perforated cage but a steady flow. In this way there is no detrimental use of the shower head but instead an active performance improvement in allowing water-soluble products such as soap or scents or the like to allow dispensing when water flows through the perforated cage.

Fixed Resilient Arm

Figure 12:
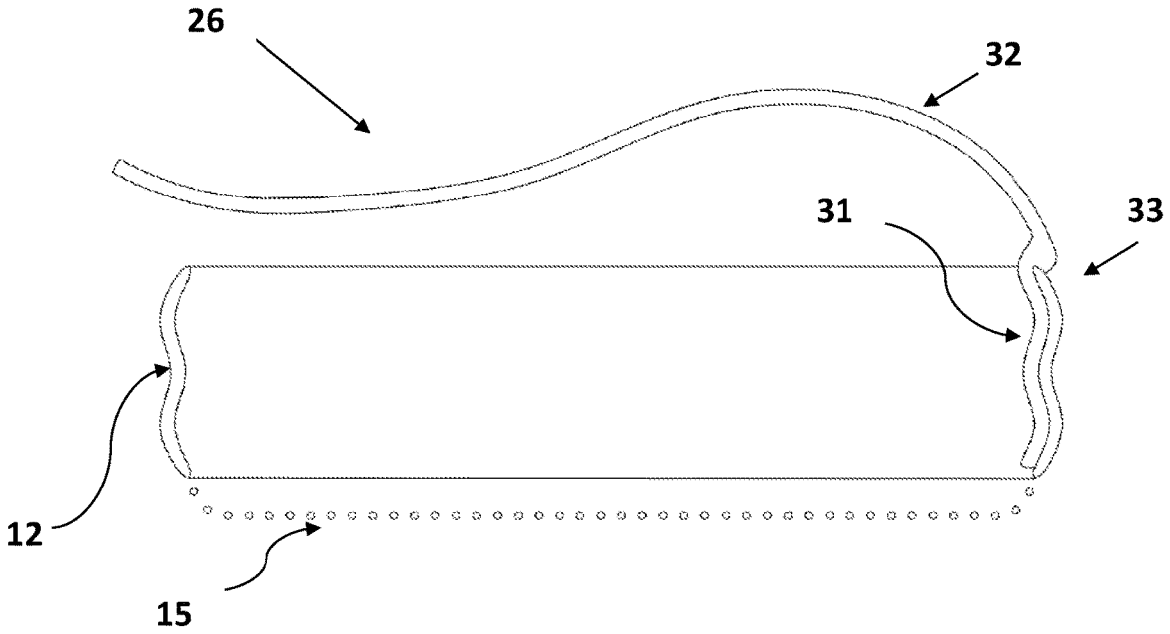
FIGS. 12, 13, 14 and 15 are diagrammatic cross sectional views of diagrammatic view of a shower head attachment in accordance with a preferred embodiment of the present invention showing various attachments of retainer to the circumferential rim of the perforated cage.

Referring to FIGS. 1 and 12 there is shown a flexible arm 32 in combination with a fixed connection 31 to connect the arm 32 to the circumferential rim 14 while allowing the perforated cage 12 to freely sit below and adjacent the shower head.

As most shower heads have a central piping inlet at the back of the shower head the resilient arm 32 is fixedly attached 31 to the circumferential rim 14 and extends inwards to extend over part of the rear of the shower head and urge it in a clamping manner towards the perforated cage so that it is held in adjacent position to the shower head.

The fixed connection can be by plastic weld or adhesive or other fixed connection.

Figure 19:
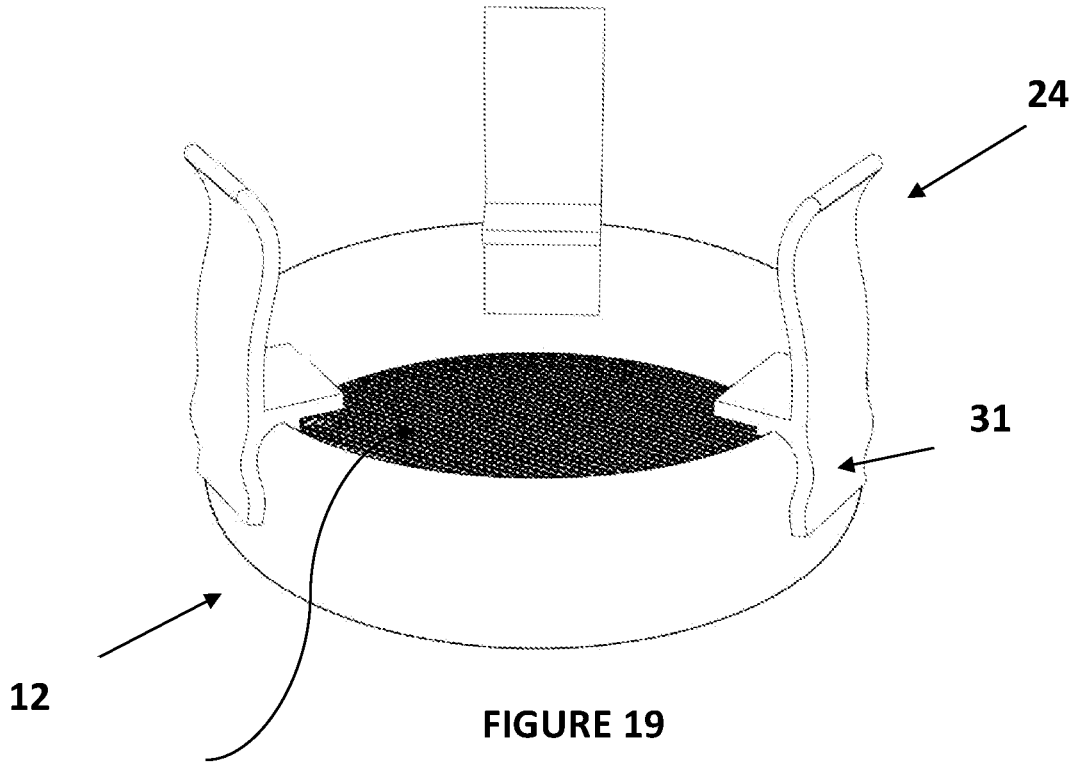
FIGS. 19 and 20 are diagrammatic views of a shower head attachment in accordance with a still further preferred embodiment of the present invention.
Figure 20:
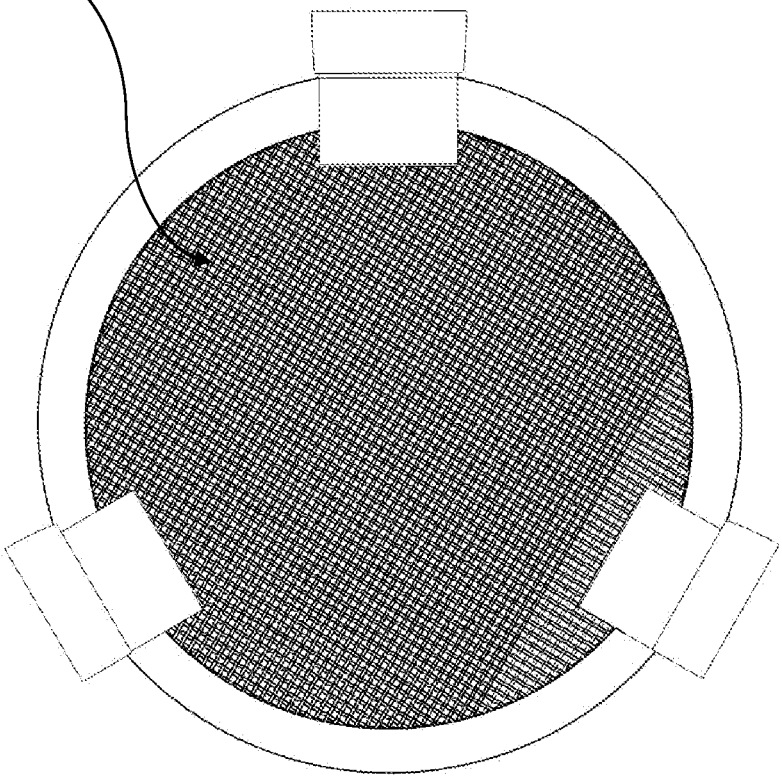

The shower head attachment can have a plurality of retainers being a plurality of resilient arms 32 extending from angularly spaced positions on the circumferential rim 14 and extending inwardly from the circumferential rim to overlay a rear of the shower head in use when the perforated cage underlies the shower head. As shown in FIGS. 19 and 20 (although showing detachable resilient arms) the arms can extend over a bell shape rear of the shower head and terminate at position allowing for the rear piping while providing the resilient clamping of the shower head to the perforated cage body 12.

In another form the one or more retainers extend from spaced opposing positions on the circumferential rim. As can be seen various arrangements of arms can be used while providing the one or more retainers are resilient towards the perforated cage to provide a resilient clamping of the shower head attachment to the shower head in use. However, the one or more retainers in this form 31 are fixed to the circumferential rim.

Detachable Resilient Arm

In another form 31 as shown in FIGS. 8, 9, 10, 13 to 15, 19, and 20, the one or more retainers 23, 24, 25 are detachably attached to the circumferential rim 14.

The one or more retainers are detachably attached to the circumferential rim by the retainer having a shaped attachment means 35 being a bifurcated structure that has a central opening 36 that matches a shaping 14 of the circumferential rim. In this way the detachable resilient arm 23, 24, 25 can readily "click" around the matching shaped circumferential rim 14.

The shaped attachment means of the detachable retainer includes a two-pronged attachment means forming an internal shaping the matches and clips over the shaping of the circumferential rim. However, it is possible for partially matching shapes to be clicked to each other.

A benefit of this arrangement is again the versatility of the attachment such that it can be sold in a easy to assemble manner and the user can locate the detachable resilient arm at a location on the circumferential rim so as to maximise the clamping effect and to avoid hitting the piping on the back of the shower head. This allows the one structure to be fitted to a range of showerheads.

Spacing Joint

The one or more retainers has a spacing joint 33 which is the connection point of the resilient arm 32 and the attachment means 31.

In the forms as shown in FIGS. 3, 4, 5, 6 and 7, the spacing joint 33 serves as the connection point of the resilient arm 32 and the attachment means 31, the spacing joint protruding slightly horizontally towards the centre of the shower head attachment. The spacing joint provides a space between the lower surface of the shower head 16 and the circumferential rim 14 of the perforated cage 12.

In other forms as shown in FIGS. 8 and 12, the spacing joint 33 serves as the connection point of the resilient arm 32 and the attachment means 31, more specifically above the shaped attachment 35 and the shaped opening 36.

The spacing joint allows the shower head attachment to be versatile by not creating a close fitting with the shower head. This then benefits the shower head attachment as it can be attached adaptively to different types of shower heads. The space created by the spacing joint likewise avoids damages and scratches between the lower surface of the shower head and the circumferential rim of the perforated cage. The spacing joint 33 also strengthens the clamping tension between the resilient arm 32 and the shower head 16 as the spacing joint acts like a platform for the shower head and the perforated cage to be stabilized in the same horizontal axis.

Shaping of Resilient Arm

A shower head attachment has resilient arms in most preferential forms so as to provide the resilient clamping of the attachment to the shower head.

The resilience of the one or more retainers can include a resilient hinge between the attachment means 31 and the resilient arm 32, 23, 24, 25.

However, another element of the resilience of the one or more retainers can includes the shaping of the resilient arm 32 so that the shaping, material, hinging or tension provides a flexibility tending to return a deformation back to the original position so as to provide a clamping tension. As shown in FIGS. 12 to 15, FIGS. 19 and 20, this can be achieved with a single continuous shape of curves 32 extending towards the perforated cage 12 or a multiple S-shaped curve 24, 25 that extend at different angles from the attachment means 31 so it attaches to a substantially flat backed shower head or to a bell shape central piping backed shower head. The shaping if the curve resists deflection and creates the resilient clamping effect. It can be understood that other variations of shapings provide this effect and are included in the scope of this invention.

Horizontal Serpentine Resilient Arm

In the form as shown in FIGS. 3, 5, 6 and 7, the retainer 20 has a resilient arm 32 in a serpentine shape wherein the first curve extends upwards from the spacing joint 33 and curves downwards towards the centre of the perforated cage, and the second curve extends diagonally downwards from the end of the second curve and then curve upwards.

Figure 10:
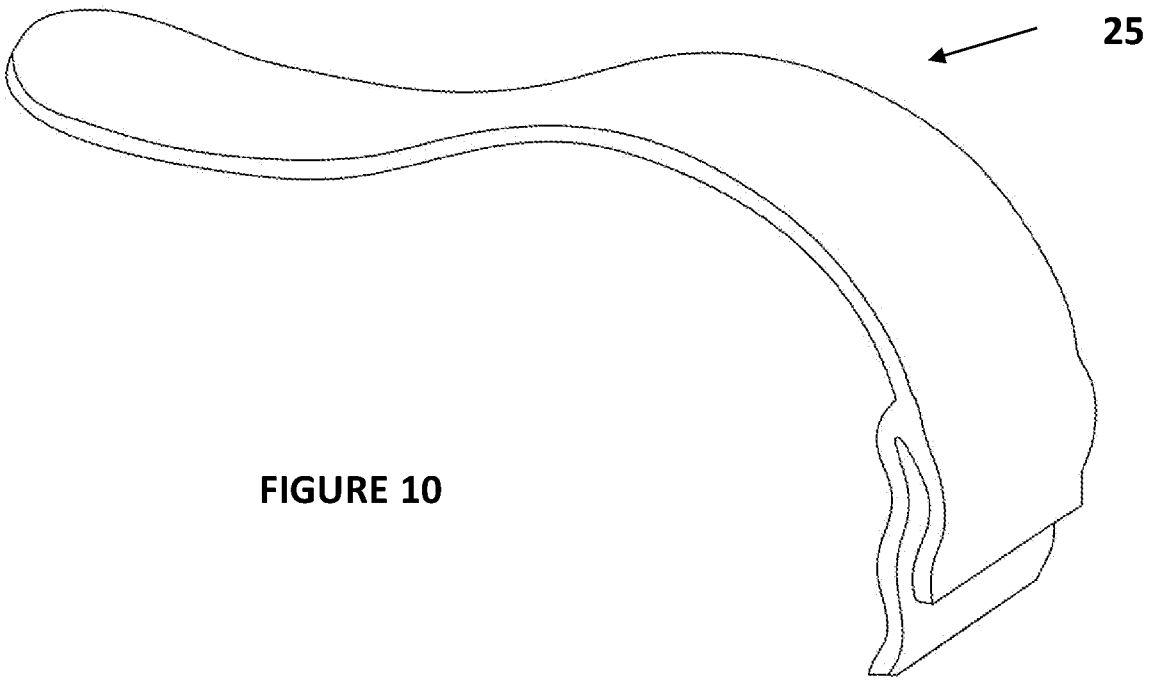
Figure 15:
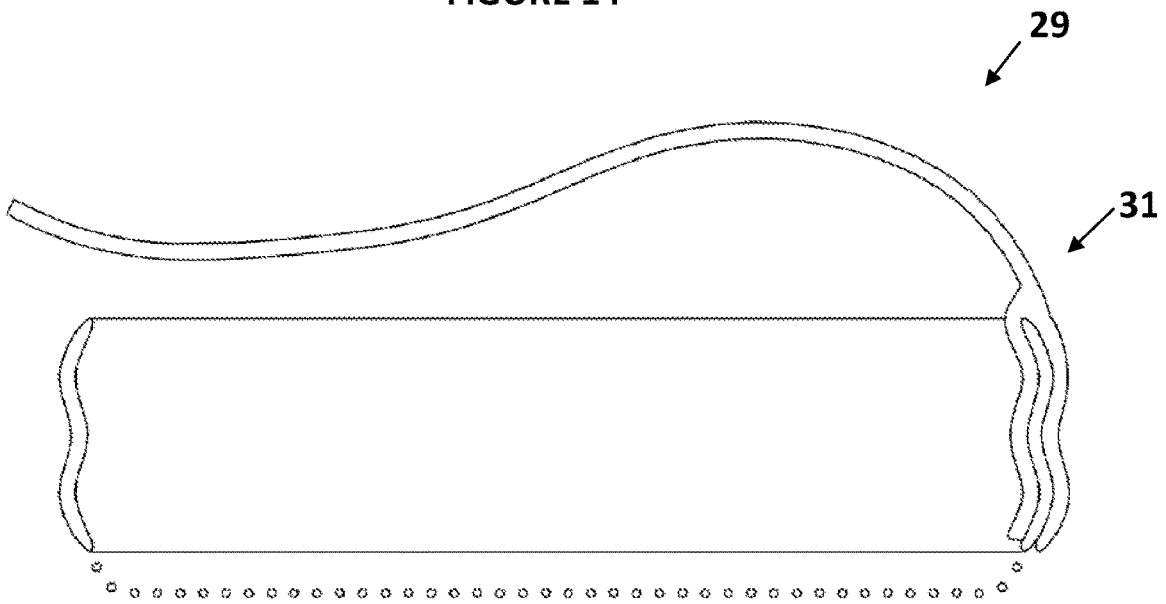

In another form as shown in FIGS. 10, 15 the retainers 25, 29 have resilient arms 32 in a serpentine shape wherein the first curve extends upwards from the spacing joint and curves downwards towards the centre of the perforated cage, and the second curve extends upwards from the end of the first curve.

When the retainers 20, 25, 29 are used to attach the perforated cage to the shower head, the serpentine resilient arm is placed on top of the upper surface of the shower head 16 and the spacing joint 33 is attached on the lower surface of the shower head, providing the resting arm a clamping effect on the upper surface of the shower head 16.

Retainers with this resilient arm allow the perforated cage to be adaptively connected to a wide variety of shower heads such as, but not limited to, flat backed shower heads or bell-shaped central piping backed shower heads.

Vertical Serpentine Resilient Arm

In another form as shown in FIGS. 4, 16,17 and 18, the one or more retainers 21 have resilient arms 32 in a narrow serpentine shape which extends vertically upwards from the spacing joint 33. When the one or more retainers 21 are used to attach the perforated cage to the shower head, the one or more retainers 21 comes into contact with the exterior rim of the shower head in different positions. The spacing joint 33 is attached on the lower surface of the shower head. This then provides the one or more retainers 21 a gripping effect on the shower head.

One or more retainers with these resilient arms allow the perforated cage to be adaptively connected to wide variety of shower heads such as, but not limited to, bell-shaped central piping backed shower heads or any shower heads with tall and bulky backends.

In another form as shown in FIGS. 9, 14, 19 and 20, the one or more retainers 24, 28 have resilient arms 32 in a wide serpentine shape which extends vertically upwards from the spacing joint, wherein the first curve extends inwards towards the centre of the perforated cage and the second curve extends upwards from the end of the first curve. When the one ore more retainers 24, 28 are used to attach the perforated cage to the shower head, the one or more retainers 24, 28 comes into contact with the exterior rim of the shower head in different positions. The spacing joint is attached on the lower surface of the shower head. This then provides the one or more retainers 24, 28 a gripping effect on the shower head.

One or more retainers with these resilient arms allow the perforated cage to be adaptively connected to a wide variety of shower heads such as, but not limited to, narrow bell-shaped central piping backend shower heads or any shower heads with a tall but narrow backends.

Convex Resilient Arm

Figure 11:
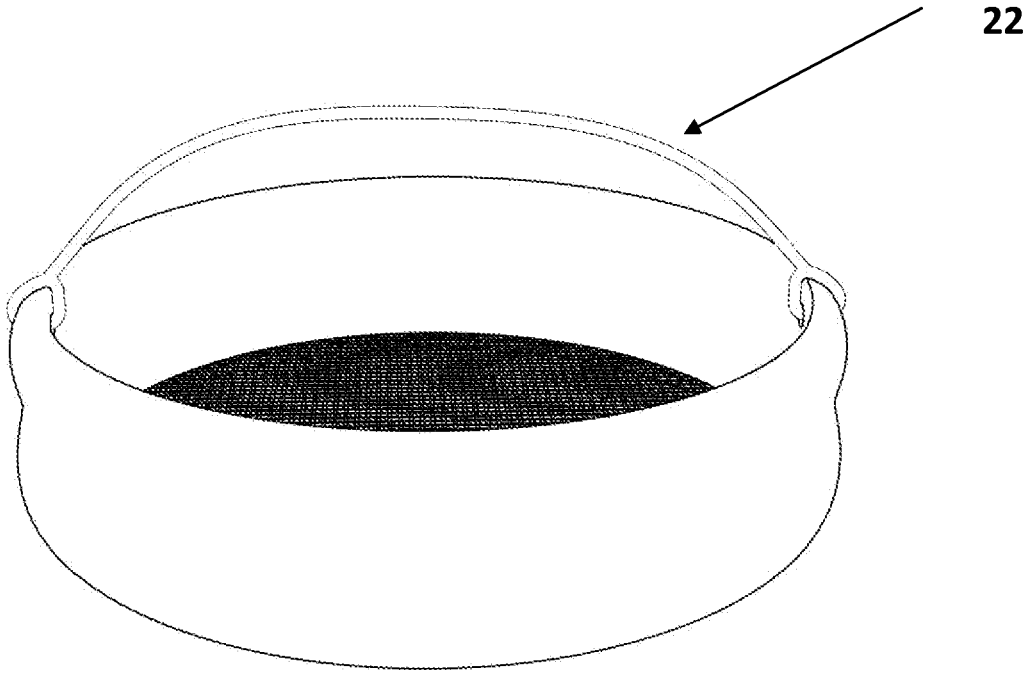
FIG. 11 is a diagrammatic view of a shower head attachment in accordance with a further preferred embodiment of the present invention.

In another form as shown in FIG. 11, the retainer 22 has a resilient arm 32 in a convex semi-circle shape wherein the first end of the semi-circle is connected to an attaching means 31 detachably attached to the circumferential rim 14, and the second end of the semi-circle is connected to another attaching means 31 detachably attached to a position in the circumferential rim 14 opposite to the position occupied by the first end. When the retainer 22 is used to attach the perforated cage to the shower head, the resilient arm 32 rests on the upper surface of the shower head and the perforated cage underlay the lower surface of the shower head.

A retainer with this resilient arm allows the perforated cage to either adaptively connect or hang on a variety of shower heads such as, but not limited to, bell-shaped central piping backed shower heads, flat backed shower heads, or show heads with short backends.

Concave Resilient Arm

Figure 13:
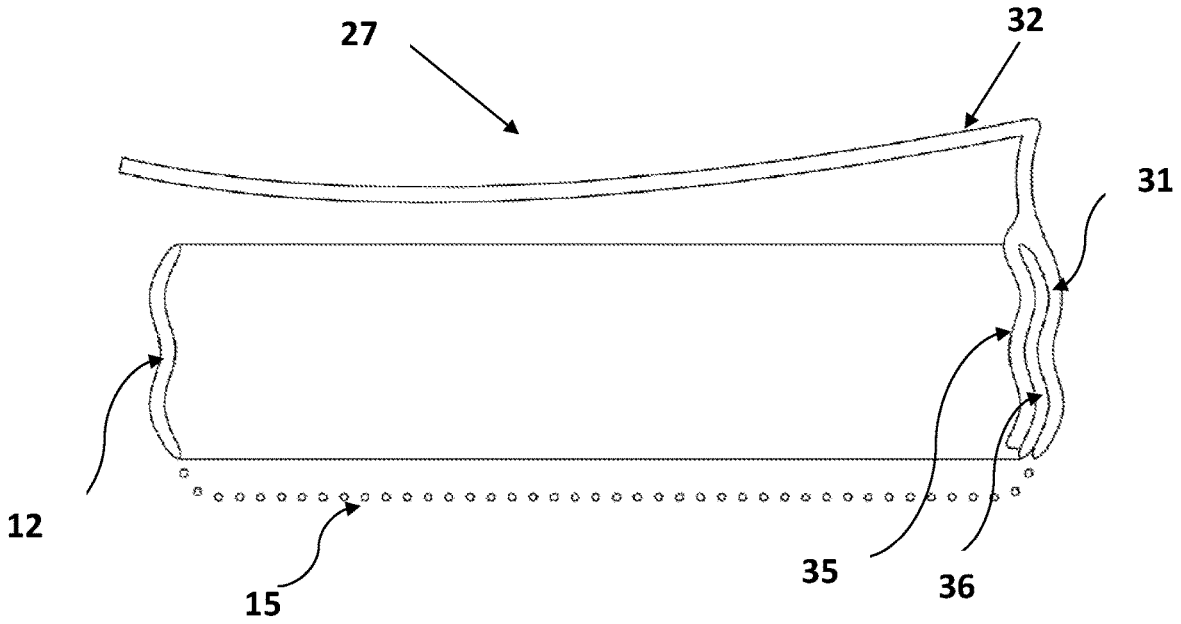
Figure 14:
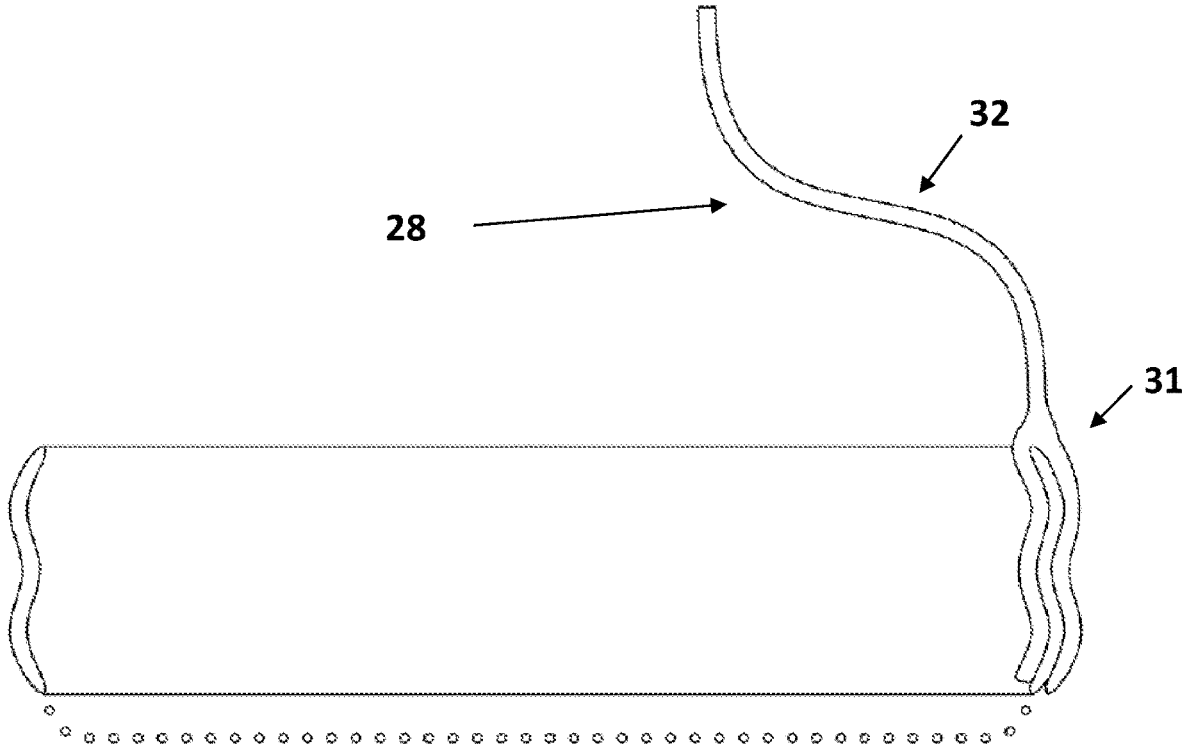

In the form as shown in FIGS. 8, 13, the retainers 23, 27 have a resilient arm 32 in a convex shape, wherein the arm extends upward from the attachment means 31 and bends horizontally in a convex shape. When retainers 23, 27 are used to attach the perforated cage to the shower head, the concave resilient arm is attached to the upper surface of the shower head and the perforated cage underlay the lower surface of the shower head. The concave shape of the resilient arm creates a clamping effect on the shower head, stabilizing the attachment of the perforated cage to the shower head.

A retainer with this resilient arm allows the perforated cage to adaptively connect on a variety of shower heads such as, but not limited to, flat backed shower heads or any short straight-edged backed shower heads.

Shaping of Circumferential Rim

In another form, the internal side and external side of the circumferential rim 14 is shaped in such a way that the attachment means 31 of the one or more retainers 20, 22, 23, 24 and 25 creates a locking effect with the circumferential rim 14.

As shown in FIG. 2, and 12 to 15 the interior and exterior sides of the circumferential rim 14 has at least one curvature running along the circumference of the rim. The shaped attachments 35 and shaped openings 36 of the one or more retainers have similar curvatures to the circumferential rim 14, providing a secure attachment between the circumferential rim and the one or more retainers.

In another form, only one side of the circumferential rim 14, either the internal side and external side, is shaped in such a way that the attachment means 31 of the one or more retainers 20, 22, 23, 24 and 25 creates a locking effect with the circumferential rim 14.

As shown in FIGS. 3 to 7 the exterior side of the circumferential rim 14 has at least one curvature running along the circumference of the rim while the interior side is flat. The attachment means 31 and shaped openings 36 of the one or more retainers have similar curvatures to the circumferential rim 14, providing a secure attachment between the circumferential rim and the one or more retainers.

This is beneficial in a way that different combinations of the body of the perforated cage 12 can be compatible with the differently shaped one or more retainers.

In Use

Figure 21:
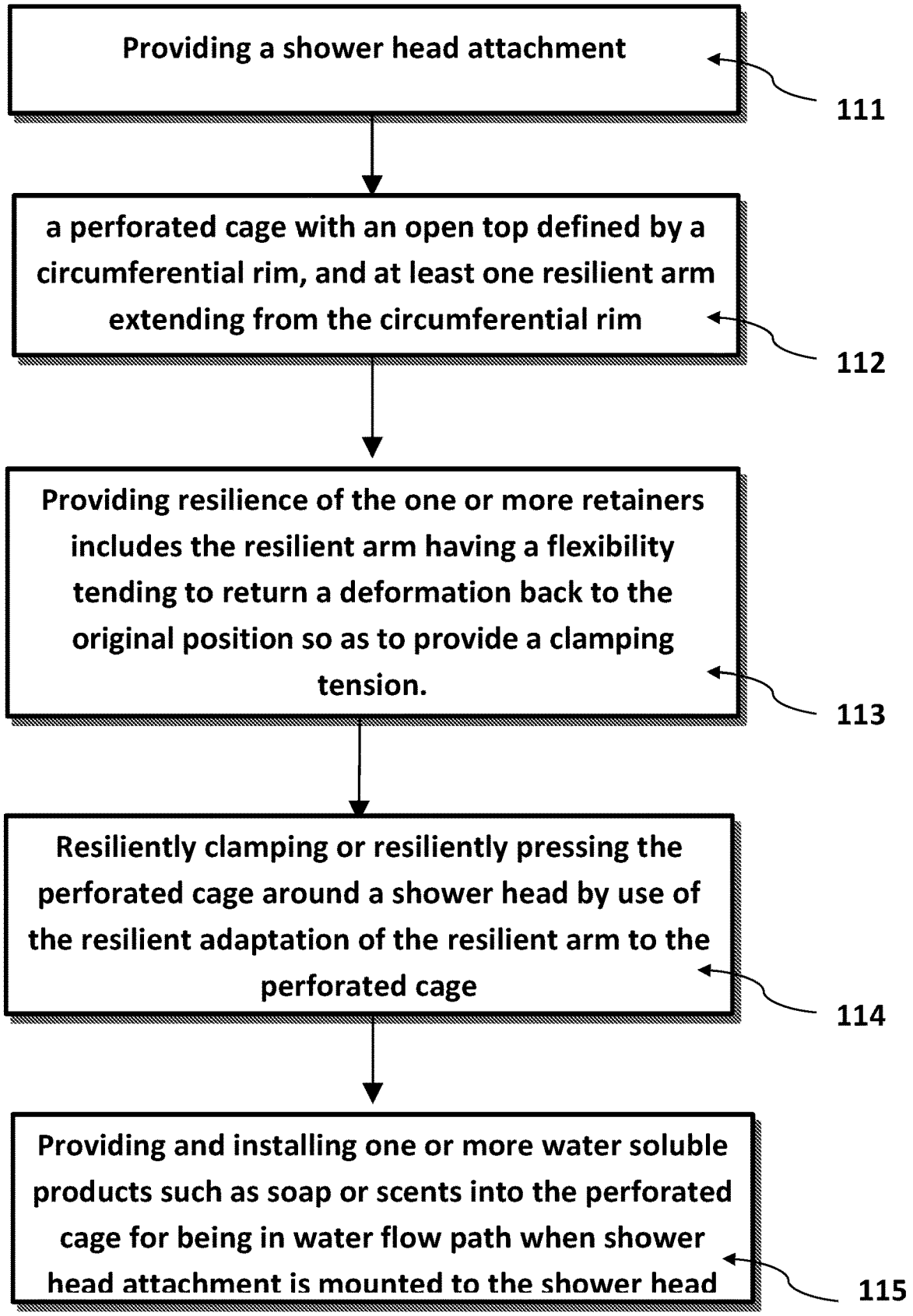
FIG. 21 is a flow chart view of a method of dispensing a water-soluble product such as soap or scents or the like from a shower head in accordance with a further preferred embodiment of the present invention.

As shown in FIG. 21 the invention provides in one form a method of dispensing a water soluble product such as soap or scents or the like from a shower head. In a first step 111 there is the need to provide a shower head attachment. However due to the novelty and inventiveness of the structure of the shower head attachment it does not need to be only specific to a single shower head design.

In a second step 112 there is provided a shower head attachment having a perforated cage with an open top defined by a circumferential rim, and providing at least one resilient arm extending from the circumferential rim.

In a third step 113 the attachment is provided with a resilience of the one or more retainers including the resilient arm having a flexibility tending to return a deformation back to the original position so as to provide a clamping tension.

With the particular shower head attachment having the properties provided by steps 111, 112 and 113 the shower head attachment can in step 114 be resiliently fitted by clamping or resiliently pressing the perforated cage to a shower head by use of the resilient adaptation of the resilient arm to the perforated cage.

In step 115, the user is able to providing and install one or more water soluble products such as soap or scents into the perforated cage for being in water flow path when shower head attachment is mounted to the shower head.

Other methods of use are incorporated within the invention.

Methods of Selection and Assembly

Thie first step is selecting an appropriate retainer with a resilient arm that fits with the shower head. The user may opt to pick a specific kind of shower head attachment with a specific retainer and resilient arm. Alternatively, the user may opt to pick a package which comprises a variety of retainers and resilient arms. The users may likewise decide to pick a fixed version of the resilient arm or a detachable version of the resilient arm.

The second step is the assembly of the shower head attachment. The step includes: a) identifying a position on the circumferential rim 14 of the perforated cage 12 where the attachment means 31 of the one or more retainers will be attached; b) inserting the upper edge of the circumferential rim in the shaped opening 36 made by the attachments means 31 of the one or more retainers; c) adjusting the attachment means 31 until a locking or stabilizing effect occurs between the attachments means and the circumferential rim.

The third step is the mounting of the shower head attachment on the shower head. The step includes: a) determining the type of resilient arm of the one or more retainers; b) attaching the resilient arm in such a way that it overlays the upper surface of the shower head; c) adjusting the spacing joint of the retainer so that it rests under the lower surface of the shower head; and d) adjusting the perforated cage with respect to the shower head in order to create a stabilized position.

More specifically in the third step, various steps of mounting the different kinds of retainers are as follows.

For horizontal serpentine resilient arms, the step includes a) attaching the serpentine resilient arm on the upper surface of the shower head; b) resting the lower surface of the shower head on the spacing joint; c) adjusting of the perforated cage to underlie the lower surface of the shower head and to create a clamping effect with the shower head through the serpentine resilient arm.

For vertical serpentine resilient arms, the step includes: a) attaching the vertical serpentine resilient arms are attached on the exterior rim of the shower head in at least two different positions; b) resting of the lower surface of the shower head on the spacing joint; c) adjusting of the perforated cage to underlie the lower surface of the shower head and to create a grabbing effect with the shower head through the vertical serpentine resilient arms.

For convex resilient arm, the step includes a) attaching the convex resilient arm on the upper surface of the shower head; b) resting the lower surface of the shower head on the spacing joint; c) adjusting the perforated cage to underlie the lower surface of the shower head and to create a clamping effect or hanging effect through the convex resilient arm.

For concave resilient arm, the step includes a) attaching the concave resilient arm on the upper surface of the shower head; b) resting the lower surface of the shower head on the spacing joint; c) adjusting the perforated cage to underlie the lower surface of the shower head and to create a clamping effect through the concave resilient arm.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the description provided herein, numerous specific details are set forth. However, it is understood that embodiments of the invention may be practiced without these specific details. In other instances, well-known methods, structures and techniques have not been shown in detail in order not to obscure an understanding of this description.

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

It is apparent from the above, that the arrangements described are applicable to the bathroom and shower industries.

The invention claimed is:

1. A shower head attachment comprising:

a perforated cage having a body with a rim at an open top, and a base having perforations extending across the bottom of the body wherein in use the perforated cage is for substantially underlying a substantial portion of the shower head perforations of a shower head; and one or more resilient retainers detachably attachable to the rim of the shower head attachment and extendible at least partially around the shower head for resiliently retaining the shower head attachment to the shower head;

wherein perforations of the perforated cage have a size and quantity relative to the size and quantity of the perforations of the showerhead so as to avoid back pressure;

wherein a resilience of the one or more resilient retainers includes a resilient hinge between an attachment means and a resilient arm.

2. The shower head attachment according to claim 1, wherein the perforated cage that, in use, underlies the shower head is adapted to contain one or more water-soluble products such as soap or scents or the like to allow dispensing when water flows through the perforated cage.

3. The shower head attachment according to claim 1, wherein the one or more resilient retainers include a rim attachment.

4. The shower head attachment according to claim 1, wherein the body of the perforated cage includes a circumferential rim surrounding the open top of the perforated cage.

5. The shower head attachment according to claim 4, wherein the circumferential rim and the one or more resilient retainers allow for ready detachable positioning on the shower head, with said perforated cage at its open top being adapted to abut and underlie a substantial portion of the shower head perforations.

6. The shower head attachment according to claim 4, wherein the one or more resilient retainers include at least two or more of the resilient arms extending from the circumferential rim to overlay a rear of the shower head in use when the perforated cage underlies the shower head.

7. The shower head attachment according to claim 4, wherein the one or more retainers extend from spaced opposing positions on the circumferential rim.

8. The shower head attachment according to claim 4, wherein the one or more retainers are fixed to the circumferential rim.

9. The shower head attachment according to claim 4, wherein the one or more retainers are detachably attached to the circumferential rim.

10. The shower head attachment according to claim 4, wherein the one or more retainers are detachably attached to the circumferential rim by the retainer having a shaped attachment means that matches a shaping of the circumferential rim.

11. The shower head attachment according to claim 10, wherein the shaped attachment means of the detachable retainer includes a two-pronged attachment means forming an internal shaping that matches and clips over the shaping of the circumferential rim.

12. The shower head attachment according to claim 1, wherein the one or more retainers are resilient towards the perforated cage to provide a resilient clamping of the shower head attachment to the shower head in use.

13. The shower head attachment according to claim 1, wherein the resilience of the one or more retainers includes the resilient arm having a flexibility tending to return a deformation back to the original position so as to provide a clamping tension.

14. A method of dispensing a water-soluble product from a shower head, the method comprising:

providing a shower head attachment having a perforated cage substantially coextensive with the shower head, the shower head attachment having an open top defined by a circumferential rim, and at least one resilient arm extending from the circumferential rim;

providing a resilience of one or more resilient retainers including the at least one resilient arm having a flexibility tending to return a deformation back to the original position so as to provide a clamping tension;

resiliently clamping the perforated cage around a shower head by use of the one or more resilient retainers adaptation of the resilient arm to the perforated cage; and providing a one or more water soluble products into the perforated cage for being in water flow path when shower head attachment is mounted to the shower head;

wherein:

a first step is selecting an appropriate one of the one or more resilient retainers with a resilient arm that fits with the shower head;

a second step is assembling the shower head attachment including:

identifying a position on the circumferential rim of the perforated cage where an attachment means of the one or more resilient retainers is attached:

inserting an upper edge of the circumferential rim in a shaped opening made by the attachments means of the one or more resilient retainers; and adjusting the attachment means until a locking or stabilizing effect occurs between the attachments means and the circumferential rim; and a third step is mounting of the shower head attachment on the shower head including:

determining a type of resilient arm of the one or more resilient retainers;

attaching the resilient arm in such a way that it overlays an upper surface of the shower head;

adjusting a spacing joint defined by a connection point of the resilient arm and the attachment means of the one or more resilient retainers so that the circumferential rim of the perforated cage rests under the lower surface of the shower head; and adjusting perforated cage with respect to the shower head in order to create a stabilized position.

15. The method of dispensing a water-soluble product from a shower head attachment according to claim 14, wherein the size and quantity of perforations of the perforated cage are less than the size and quantity of the perforations of the showerhead so as to avoid back pressure.

16. The method of dispensing a water-soluble product from a shower head attachment according to claim 14, wherein the shower head attachment is positioned on the shower head without disassembly of the shower head by means of providing one or more resilient retainers being detachably attached to the circumferential rim of the shower head attachment and extendible at least partially around the circumferential rim for resiliently retaining the shower head attachment to the shower head.

17. The method of dispensing a water-soluble product from a shower head attachment according to claim 14, wherein the one or more resilient retainers are shaped and sized to fit a range of different sized shower heads.

18. The method of dispensing a water-soluble product from a shower head attachment according to claim 14, wherein the one or more resilient retainers have shape to complement the shape of a peripheral wall of the perforated cage.

19. The method of dispensing a water-soluble product from a shower head attachment according to claim 14, wherein the one or more resilient retainers have resilience formed by shaping of the resilient arm by one or more of a convex resilient arm, a concave resilient arm, a horizontal serpentine resilient arm and a vertical serpentine resilient arm.

20. A kit for dispensing a water-soluble product from shower head, the kit comprising:

a perforated cage having a body with a rim at an open top, and a base having perforations extending across the bottom of the body wherein in use the perforated cage is for substantially underlying a substantial portion of shower head perforations of a shower head;

a plurality of different sets of resilient retainers configured to each be detachably attachable to the rim of the shower head attachment and extendible at least partially around the shower head for resiliently retaining the shower head attachment to the shower head; and wherein the user can select one set of the plurality of different sets of resilient retainers according to the size and type of their shower head and attach the selected set of resilient retainers to the rim of the perforated cage to allow mounting to their shower head.

* * * * *